US005458302A

United States Patent [19]

Volkoff

[11] Patent Number: 5,458,302

[45] Date of Patent: Oct. 17, 1995

[54] NURSING BOTTLE HOLDER

[76] Inventor: George B. Volkoff, 1827 Ashmeade Ct., San Jose, Calif. 95125

[21] Appl. No.: 239,961

[22] Filed: May 9, 1994

[51] Int. Cl.[6] ..... A47D 15/00

[52] U.S. Cl. ..... 248/107; 248/126; 248/175; 215/11.1; 215/399

[58] Field of Search ..... 215/11.1, 100 R; 224/148; 248/102, 104, 105, 107, 126, 175

[56] References Cited

U.S. PATENT DOCUMENTS

| | | | |
|---|---|---|---|
| 717,995 | 1/1903 | Holton | 248/102 |
| 1,281,948 | 10/1918 | Guiterman | 248/102 |
| 1,322,656 | 11/1919 | Treadwell et al. . | |
| 1,662,518 | 3/1928 | Jaffe et al. | 248/104 |
| 1,863,163 | 6/1932 | Malti et al. | 248/102 |
| 1,867,992 | 7/1932 | Sullivan | 248/104 |
| 2,280,940 | 4/1942 | Wightman . | |
| 2,654,556 | 10/1953 | Lathrop . | |
| 2,703,689 | 3/1955 | Williams | 248/107 |
| 2,912,200 | 11/1959 | Reinhorn . | |
| 3,197,099 | 7/1965 | Doba | 224/148 |
| 3,635,431 | 1/1972 | Mariner | 248/104 |

*Primary Examiner*—Allan N. Shoap
*Assistant Examiner*—Christopher J. McDonald
*Attorney, Agent, or Firm*—Henry M. Stanley

[57] ABSTRACT

A unitary nursing bottle holder has an upper coil which is used to hang the bottle holder from an overlying member such as an infant carrier handle or an overhead infant swing seat support. A connecting segment is attached to the upper coil hanger at one end and to a lower combination handle and bottom rest at the other end. A bottle rest and bottle holder segment is attached to the other end of the lower combination handle and bottom rest. The elements of the holder are connected serially so that the holder may be fabricated from a continuous rod. A soft non-toxic covering, such as a vinyl tube is applied to the rod.

20 Claims, 2 Drawing Sheets

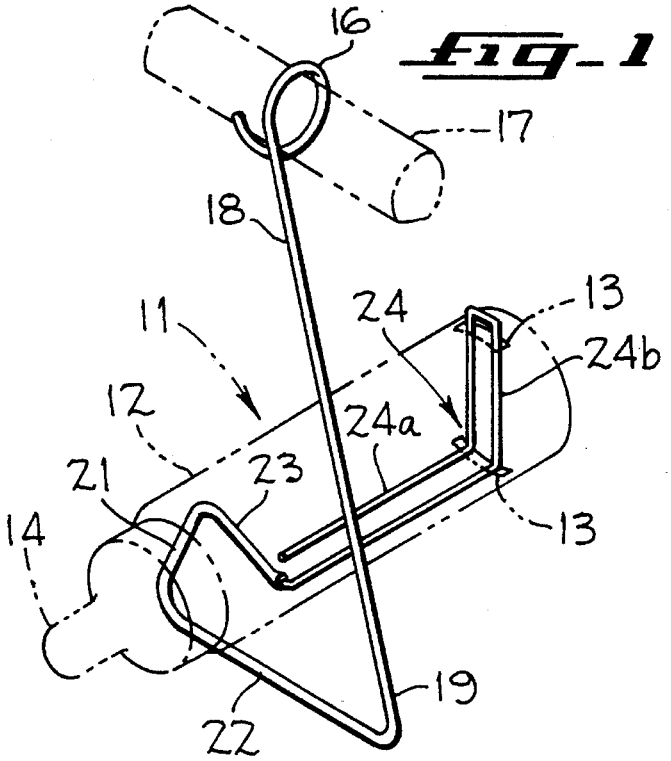
fig_1
fig_2
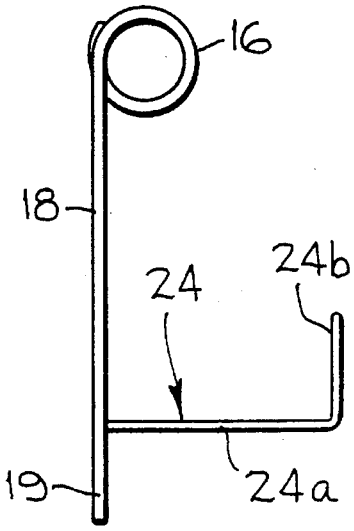
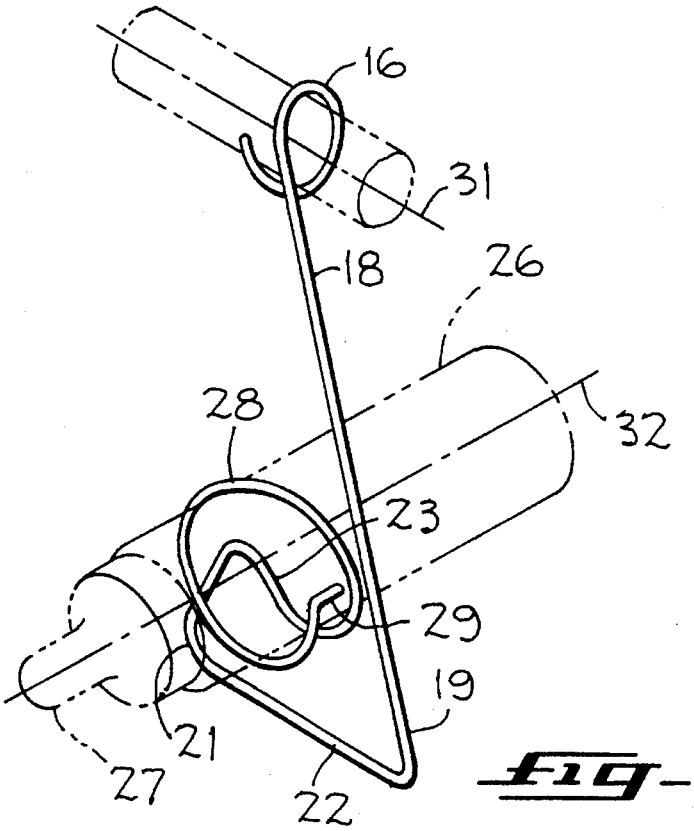
fig_3 fig_4
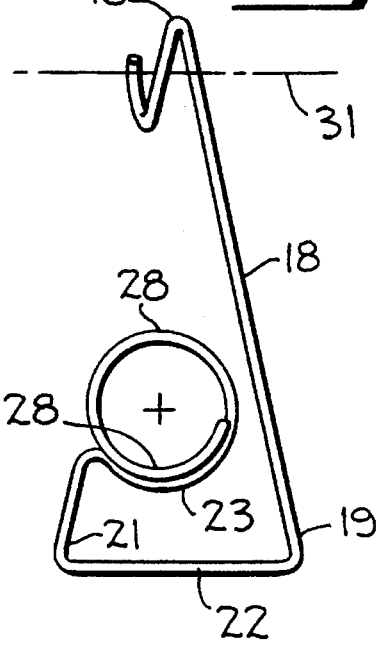
fig_5
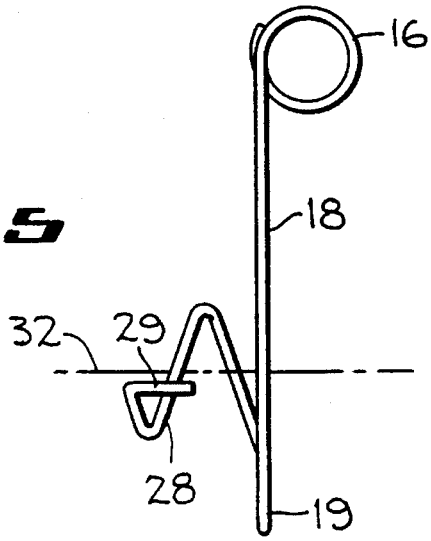
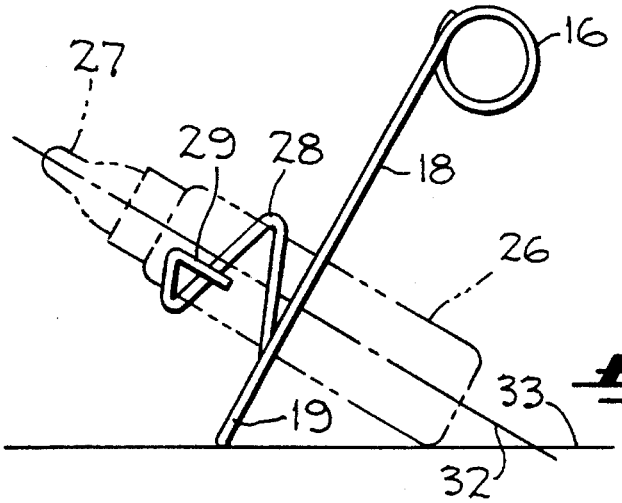
fig_6

NURSING BOTTLE HOLDER

SUMMARY OF THE INVENTION

The invention relates to apparatus for holding a nursing bottle having a nipple end and an opposing end. The apparatus includes an upper hanging coil, a lower rest portion having first and second sides, and a connecting segment disposed between and connected to the upper hanging coil and the lower rest portion first side. A bottle holder is connected to the lower rest portion second side so that a nursing bottle may be held therein and suspended from an overlying member by the upper hanging coil.

In another aspect of the invention, a nursing bottle holder is made from a continuous rod, wherein the continuous rod has formed thereon, in sequence, an upper hanging coil, a connecting segment connected to the upper hanging coil, and a lower rest having spaced first and second handle/support segments and a handle/rest segment extending therebetween. The first handle/support segment is connected to the connecting segment. A bottle holder has a bottle rest segment and a bottle engagement segment, wherein the bottle rest segment is connected to the second handle/support segment. As a result, a unitary nursing bottle holder is provided for suspending a nursing bottle from an overhanging member for the convenience of a nursing infant.

BRIEF DESCRIPTION OF THE DRAWINGS

FIG. 1 is a perspective view of one embodiment of the nursing bottle holder.

FIG. 2 is a side view of the nursing bottle holder shown in FIG. 1.

FIG. 3 is a perspective view of another embodiment of the nursing bottle holder.

FIG. 4 is a front view of the nursing bottle holder of FIG. 3.

FIG. 5 is a side view of the nursing bottle holder of FIG. 3.

FIG. 6 is a side view of the nursing bottle holder functioning as a bottle stand.

DESCRIPTION OF THE PREFERRED EMBODIMENTS

Nursing infants are often held in a parent's or a caretaker's arms while nursing from a bottle. There are times, however, when the parent or caretaker may wish to undertake other activities while the infant requires a nursing bottle. In such a case the invention disclosed herein is useful in allowing the parent or caretaker to pursue these other activities while still satisfying the infant's requirement for nursing fluids.

One type of infant nursing bottle has a firm outer shell with a contained bladder and a nipple at one end in communication with the bladder. At the opposite end of the firm outer shell two radially aligned slots are formed. With reference to FIG. 1, such a nursing bottle 11 is shown in dashed lines having the aforementioned firm outer shell 12 and the pair of radially aligned slots 13 in the end of the shell which is distal from a nipple 14. The embodiment of FIG. 1 has an upper hanging coil 16 which is formed as a spiral having at least 360° of arc. Infant carriers typically have a carrying handle which extends across the carrier in an overlying position. Other articles designed for use by infants also have overlying cross members. Such articles include spring supported infant seats and overhead supported infant swings. In any event, the upper hanging coil 16 is formed so that it may be placed over an overlying member 17 (such as shown in dashed lines in FIG. 1) which may be the aforementioned infant carrier handle or the like. A connecting segment 18 is attached to the upper hanging coil 16 extending downwardly therefrom. A rest/handle portion of the bottle holder has two side support/handle lengths 19 and 21 and a bottom rest/handle length 22 extending therebetween. The side support/handle length 19 is connected to the lower end of the connecting segment 18 as seen in FIG. 1. A bottle holder has a bottle rest 23 connected to the side support/handle length 21 as well as a slot engagement extension member 24 attached to the bottle rest 23. The slot engagement extension has a portion **24*a* which serves to support the under surface of the bottle outer shell 12, and an upwardly extending portion 24*b*. The upwardly extending portion of the slot engagement extension is configured to pass through the radially aligned slots 13 in the firm outer shell 12 of the bottle 11**, as shown, to thereby secure the bottle in place in the bottle holder during nursing by an infant.

The upper hanging coil 16 in the preferred embodiment of FIG. 1 has a coil diameter of approximately 1 ½ to 2 inches and requires several deliberate sequential motions to couple the hanger over the overlying support member 17. These motions are unlikely to be undertaken by an infant and therefore the upper hanging coil is unlikely to be moved off of the overlying support member 17 by an infant during nursing even though the infant may move the bottle holder around by contacting the bottle, the bottom handle length 22, or either of the side support handle lengths 19 and 21. Additionally, if it is necessary to shorten the length of the connecting segment 18 as the infant grows larger, such shortening may be accomplished by increasing the number of degrees of arc in the upper hanging coil 16, thereby transferring part of the length of the connecting segment 18 to the hanging coil 16. It has been found that about 360° of arc minimum is sufficient to avoid dislodgment of the upper hanging coil 16 by an infant from the overlying support member 17. The models built in accordance with the disclosure herein utilized a variety of degrees of arc greater than 360°.

It has also been found that it is advantageous to use a continuous rod of about ⅛ inch or 3/32 inch in diameter to fabricate the nursing bottle holder of FIG. 1. Thirty six inch rod lengths are readily available in aluminum rod which is easily bent into the illustrated shape. A covering is placed over the rod which may take any nontoxic form. A non DOP plasticized PVC tubing or coating may be used. A vinyl tube was used in the preferred embodiment which extended from the end of the rod at the upper hanging coil 16 to the end of the bottle rest segment 23 in the embodiment of FIG. 1. As a result, the infant may grasp the side handle lengths 19 and 21 as well as the bottom handle length 22 without fear of picking up dirt or discoloration from the aluminum rod. Moreover, the infant may use these segments of the nursing bottle holder for teething purposes without danger of injury to the infant's mouth. Other materials susceptible to being formed in the shapes disclosed herein may be used.

FIG. 2 shows the embodiment of FIG. 1 from the side thereof so that the relative positions of the various lengths of the continuous member from which the nursing bottle holder is fabricated may be more clearly seen. It should be noted that the nontoxic coating on the rod is omitted from the slot engagement extension 24 for convenience because of the size of the radially aligned slots 13 in the firm outer shell 12 of the bottle 11.

Turning now to FIG. 3 of the drawings an alternative embodiment of the present invention is shown. The upper hanging coil 16 is included as described in conjunction with the embodiment of FIG. 1. The connecting segment 18 is also as described in conjunction with the embodiment of FIG. 1 as is the feature for shortening the connecting segment 18 by increasing the number of degrees of arc contained in the upper hanging coil 16. However, as mentioned before the upper hanging coil 16 includes at least 360° of arc in the circumference thereof. Also similar to the features and characteristics of the embodiment of FIG. 1 are the side support/handle lengths 19 and 21 and the bottom rest/handle length 22 shown in FIG. 3. Bottle rest segment 23 is also included in the embodiment of FIG. 3.

The configuration of a nursing bottle 26 as shown in FIG. 3 differs from the configuration 11 shown in FIG. 1, although the embodiment of the invention shown in FIG. 3 will also accept the bottle 11 configuration. The bottle 26 has a solid outer wall with a nipple 27 on one end. As a result, a single spiral coil 28 is attached to the bottle rest 23 whereby the single spiral coil 28 together with the bottle rest 23 completely surrounds the outer surface of the bottle 26 proximate to the nipple end thereof. There is a free end on the spiral coil 28 which has a coil diameter adjustment tab 29 attached thereto. The adjustment tab 29 is oriented to extend away from the nipple 27 and is positioned so that pressure on the tab 29 will open the diameter of the spiral coil 28 slightly to allow ease of insertion and removal of the bottle 26 from the inner diameter of the coil 28. It should be noted that an axis 31 of the upper hanging coil 16 extends in a direction generally parallel to the long axis of the overhanging supporting member 17 as shown in dashed lines in both FIGS. 1 and 3. An axis 32 through the spiral coil 28 of FIG. 3 is seen to be spaced from and generally perpendicular to the axis 31. FIGS. 4 and 5 are provided as side and front views respectively of the embodiment of the nursing bottle holder of FIG. 3 to clarify the positions of some of the elements of the holder of FIG. 3. It should be noted that the embodiment of FIG. 3 is also fabricated from a continuous ⅛ inch or 3/32 inch diameter aluminum rod wherein a length of approximately 3 feet is needed to form the illustrated nursing bottle holder. The coil 28 will accommodate bottles of still larger or smaller diameters. The rod of the embodiment of FIG. 3 is, as in the case of the embodiment of FIG. 1, coated with a soft nontoxic coating, such as soft vinyl tubing. The at rest inner diameter of the spiral coil 28 is formed to firmly engage the outside diameter of the smallest nursing bottles. As a result, bottles with outside diameters from approximately 2 inches to approximately 2 ¼ inches are firmly held within the spiral coil 28 and supported on the bottle rest 23. Other materials may be used as noted in conjunction with the embodiment of FIG. 1.

With reference to FIG. 6, the embodiment of the nursing bottle holder of FIG. 3 is shown supporting the bottle 26 illustrated in dashed lines. The nursing bottle holder has been removed from the overlying support member 17 and taken from the vicinity of the infant to be placed on a flat underlying surface 33. In such a case the bottle holder serves as a bottle stand, keeping the nipple 27 in an elevated position so that contained fluids are not allowed to drip out of the bottle while it is supported by the bottle holder used as a bottle stand. While not illustrated specifically, the bottle holder of FIG. 1 also serves as a bottle stand in the same fashion. It should also be noted that in both the embodiments of FIGS. 1 and 3 the bottle holders 23 together with respective holding structures 24 and 28 may be rotated about the long axis of the bottom rest/handle length 22 to position the bottle nipple closer to the infant with counterclockwise rotation as seen in FIGS. 2 and 5 and to position it further from the infant with clockwise rotation about the axis of length 22 as seen in FIGS. 2 and 5.

From the foregoing it may be seen that the invention described herein is difficult for an infant to dislodge from an overlying support member, provides vertical and horizontal handle segments for an infant to grip, will easily accept bottles of various diameters, provides easy insertion and removal of bottles from the holder, allows positioning of the bottle both vertically and horizontally to accommodate the infant, avoids protrusions which may be injurious to an infant, provides segments which function as teething surfaces, and also functions as a dripless bottle stand.

Although the best mode contemplated for carrying out the present invention has been herein shown and described, it will be understood that modification and variation may be made without departing from what is regarded to be the subject matter of the invention.

What is claimed is:

1. Apparatus for suspending a nursing bottle having a nipple end and an opposing end from an overlying cross member, comprising open upper hanging coil means surrounding the overlying cross member, a lower rest having first and second sides, a connecting segment disposed between and connected to said upper hanging coil and said lower rest first side, and bottle holder means connected to said lower rest second side for holding the nursing bottle in an inclined position for nipple end access by an infant.

2. Apparatus as in claim 1 wherein said open upper hanging coil means comprises a coil extending through at least 360° of arc, whereby upward, downward or lateral force on a suspended nursing bottle or the suspending apparatus will not dislodge said upper hanging coil means from the overlying cross member.

3. Apparatus as in claim 1 for use with a nursing bottle which has a firm outer shell and a contained bladder, the firm outer shell having radially aligned slots therein near the opposing end thereof, said bottle holder means comprising a bottle rest segment, and a slot engagement extension connected to said bottle rest segment and configured to extend through the radially aligned slots.

4. Apparatus as in claim 1 wherein said bottle means holder comprises a bottle rest segment, and a single spiral variable diameter coil extending from and having one end attached to said bottle rest segment, said spiral variable diameter coil having a free end.

5. Apparatus as in claim 4 wherein said open upper hanging coil means has a predetermined coil axis orientation, and wherein said single spiral variable diameter coil has a coil axis orientation spaced from and substantially orthogonal to said open upper hanging coil means orientation.

6. Apparatus as in claim 4 comprising a coil diameter adjust tab attached to said single spiral variable diameter coil free end, whereby bottles with diameters within a predetermined range are secured in said bottle holder coil.

7. Apparatus as in claim 1 wherein said lower rest comprises a bottom rest length extending between said first and second sides.

8. Apparatus as in claim 1 wherein said open upper hanging coil means, connecting segment, lower rest and bottle holder are connected serially, and wherein increasing the degrees of arc in said upper hanging coil means provides shortening of said connecting segment and adjustment of said bottle holder height.

9. Apparatus as in claim 1 comprising a soft non-toxic coating overlaying said lower rest and said bottle holder.

10. Apparatus as in claim 9 comprising a soft non-toxic coating overlaying said upper hanging coil and said connecting segment.

11. Apparatus as in claim 1 wherein said lower rest comprises a bottom rest length extending between said first and second sides, said bottom rest length functioning as a handle available to an infant during nursing when the apparatus is suspended by said open upper hanging coil and as a bottle stand maintaining the nipple end in an elevated position when the apparatus is not suspended and is placed with the bottom rest length contacting and underlying support surface.

12. A nursing bottle holder for suspension from an overlying cross member, comprising a continuous rod, said continuous rod having formed thereon, in sequence, an open upper hanging coil for surrounding the overlying cross member, a connecting segment connected to said open upper hanging coil, a lower rest having spaced first and second handle support segments and a handle/rest segment extending therebetween, said first handle/support segment being connected to said connecting segment, and a bottle holder having an underlying bottle rest segment and a bottle engagement segment extending therefrom, said bottle rest segment being connected to said second handle/support segment.

13. A nursing, bottle holder as in claim 12 comprising a soft non-toxic coating on said continuous rod.

14. A nursing bottle holder as in claim 12 for use with a nursing bottle having a firm outer shell and a contained bladder, a nipple communicating with the bladder on one end of the firm outer shell and a pair of radially aligned slots proximate to the opposing end, said bottle engagement segment comprising a slot engagement extension configured to extend upwardly through the radially aligned slots.

15. A nursing bottle holder as in claim 12 wherein said bottle engagement segment comprises a single spiral variable diameter coil having a free end distal from said bottle rest segment, whereby bottles with diameters within a predetermined range are secured in the holder.

16. A nursing bottle holder as in claim 15 comprising a spiral coil diameter adjust tab attached to said free end.

17. A nursing bottle holder as in claim 12 wherein said upper hanging coil comprises a coil extending through at least 360° of arc.

18. A nursing bottle holder as in claim 15 wherein said upper hanging coil has a predetermined coil axis orientation, and wherein said single spiral coil has a coil axis orientation spaced from and substantially orthogonal to said upper hanging coil orientation.

19. A nursing bottle holder as in claim 12 wherein said handle/rest segment comprises means for rotationally moving said bottle holder about the longitudinal axis of said handle/rest segment, whereby bottle tilt is adjustable.

20. A nursing bottle holder as in claim 12 wherein said handle/rest segment comprises dual function means for providing a handle available to an infant during nursing when the bottle holder is suspended by said open upper hanging coil and for providing a stand for the nursing bottle maintaining a nipple end of the nursing bottle in an elevated position when the bottle holder is not suspended and is placed with the handle/rest segment contacting an underlying support surface.

* * * * *